US006322460B1

(12) United States Patent
Asci

(10) Patent No.: US 6,322,460 B1
(45) Date of Patent: Nov. 27, 2001

(54) BATTING PRACTICE DEVICE

(76) Inventor: Michael Asci, 12 Norval Ave., Stoneham, MA (US) 02180

( * ) Notice: Subject to any disclaimer, the term of this patent is extended or adjusted under 35 U.S.C. 154(b) by 0 days.

(21) Appl. No.: 09/415,968

(22) Filed: Oct. 12, 1999

(51) Int. Cl.[7] ..... A63B 69/00

(52) U.S. Cl. ..... 473/422; 473/462; 473/429; 473/425; 473/430; 473/438; 24/114.5

(58) Field of Search ..... 473/422, 423, 473/429, 430, 431, 425, 459, 462, 493, 103, 104, 108; 273/317.6, 317.8; 24/450–461, 66.11, 114.5; D8/356

(56) References Cited

U.S. PATENT DOCUMENTS

| | | | | |
|---|---|---|---|---|
| D. 387,978 | * | 12/1997 | Mcnally, Jr. | D8/356 |
| 2,890,848 | * | 6/1959 | Johnson, Jr. | 24/66.11 |
| 4,020,531 | * | 5/1977 | Ahrens et al. | 24/458 |
| 4,270,250 | * | 6/1981 | Schön | 24/114.5 |
| 4,696,471 | * | 9/1987 | McGrath et al. | 473/462 |
| 4,911,442 | * | 3/1990 | Monroe et al. | 473/462 |
| 5,386,986 | * | 2/1995 | Gamboa | 473/430 |
| 5,458,326 | | 10/1995 | Marcyes . | |
| 5,624,113 | | 4/1997 | Rabine . | |
| 5,649,699 | * | 7/1997 | Todoroff | 473/425 |
| 5,683,315 | | 11/1997 | Ring . | |
| 5,755,630 | | 5/1998 | Malwitz . | |
| 5,766,102 | | 6/1998 | Lawson et al. . | |
| 5,769,744 | * | 6/1998 | Merrill et al. | 473/493 |
| 5,800,290 | * | 9/1998 | Barry | 473/438 |

* cited by examiner

*Primary Examiner*—Jeanette Chapman
*Assistant Examiner*—Mitra Aryanpour
(74) *Attorney, Agent, or Firm*—O'Connell Law Firm

(57) ABSTRACT

A batting practice device comprising a resiliently flexible and elongate retaining rod, a target member coupled to a distal end of the elongate retaining rod, and a clamping structure for clamping a proximal end of the elongate retaining rod to an environmental structure, such as chain link fence. The target member may be coupled directly to the distal end of the elongate retaining rod as by having the elongate retaining rod pass through a bore hole in the target member. A fixed or selectively removable ball stop may retain the target member on the elongate retaining rod. The clamping structure may incorporate a first clamping block and a second clamping block and a threaded clamping nut that selectively presses the blocks together. The first and second clamping blocks can have first and second elongate clamping furrows for engaging adjacent strands on a chain link fence. Pins may project from the first clamping block to engage bore holes in the second clamping block to prevent relative rotation of the first clamping block relative to the second clamping block. The retaining sleeve can be tubular so that the proximal end of the elongate retaining rod can pass therethrough to be selectively fixed in place.

16 Claims, 3 Drawing Sheets

BATTING PRACTICE DEVICE

FIELD OF THE INVENTION

The present invention relates generally to sporting implements. Stated more particularly, this patent discloses and protects a batting practice device for aiding a ball player in practicing and improving his or her batting ability and for allowing a player to warm up prior to a game or a given at bat.

BACKGROUND OF THE INVENTION

Becoming a better hitter is certainly an object of every baseball and softball player. Similarly, nearly all players in such sports typically find it advantageous to warm up prior to each game. Still further, most players seek to take a number of practice swings immediately prior to a given at bat to refresh muscle memory, to warm up, and, possibly, to quell any nerves that might interfere with proper batting.

Unfortunately, even during practice sessions, it is often difficult for a batter to get as much practice as he or she might desire or, indeed, require. With this, a hitter may be deprived of the practice needed to become truly proficient. Although pitching machine have been disclosed that may be useful tools for enabling a hitter to get more of the practice that is essential to developing a proper hitting technique, like an actual human pitcher, use of such machines or a human pitcher require not only the batting practice pitcher or the pitching machine, but they also require an open field and persons to shag the batted balls. These requirements render such practice methods problematic for an individual user and particularly impracticable for a batter while a game is underway. Accordingly, it will be appreciated that it is desirable to provide a means for a ball player to practice to practice batting in a limited space without interfering with non-practice areas and without requiring the retrieval of a ball with each practice swing.

Advantageously, as one knowledgeable in the art will be aware, a number of inventors have sought to provide batting practice devices that meet the aforementioned needs of ball players. These devices are of undisputed utility, and they have undeniably improved batters' abilities by allowing extended, individual practice sessions. They have also enabled unobtrusive opportunities for a batter to warm up prior to a game or a given at bat.

Unfortunately, though, the devices of the prior art suffer from a number of disadvantages that together make clear that there remains a need in the art for an improved batting practice device. For example, many batting practice devices of the prior art are complex in construction whereby they are susceptible to malfunction and breakage and are relatively expensive and difficult in manufacture, installation, and repair. By way of example, many prior art batting practice devices provide a target member for being struck that is retained at a first end of a tether that, in turn, is retained by its second end by a retaining structure. In these devices, the tether can become entangled, a swiveling structure can become worn or broken, the swinging target member can strike the user or an observer, and the tether can break thereby creating danger, expense, and delay. Furthermore, many prior art devices require tools and demand a significant expenditure of time and effort for their installation. With this, use of the devices can be delayed and even discouraged.

With these things in mind, it becomes clear that a batting practice device that overcomes the deficiencies of its predecessors while providing a number of heretofore unrealized advantages thereover would represent a marked advance in the art.

SUMMARY OF THE INVENTION

Advantageously, the present invention sets forth with the broadly stated object of providing a batting practice device that solves each of the problems left by the prior art while providing a number of heretofore unrealized advantages thereover.

A most basic object of the invention is to provide a batting practice device that enables a ball player to practice batting in a limited space without a need for other players or assistance.

A further object of the invention is to provide a batting practice device that is exceedingly simple and durable in construction.

Still another object of the invention is to provide a batting practice device that can be coupled to an environmental structure, such as a fence, in a rapid manner without a need for tools.

These and further objects and advantages of the present invention undoubtedly will be obvious both to one who has an opportunity to enjoy the use of an embodiment of the present invention and to one who reviews the present disclosure.

In carrying forth these objects, a most basic embodiment of the invention essentially comprises a batting practice device for enabling a user to practice batting and to warm up prior to a game or a given at bat. The batting practice device is founded on an elongate retaining rod, a target member that is coupled to a distal end of the rod, and a means for supporting the proximal end of the rod. Advantageously, even under this most basic embodiment, a ball player can practice batting and can warm up prior to a game or a given at bat by striking the target member with a striking implement.

Preferably, the target member will be affixed directly to the distal end of the elongate retaining rod without the intervention of any tether or other structures that have been employed in the prior art. Furthermore, the preferred elongate retaining rod will be resiliently flexible whereby the target member and the elongate retaining rod will tend to deflect in response to an impact by a striking implement and whereby the target member and the elongate retaining rod will tend to return approximately to an initial position after an impact by a striking implement. Still further, a most preferred elongate retaining rod will be formed from a strand of wire rope coated with a plastic sheath. With this, the elongate retaining rod will demonstrate exemplary durability while not tending to damage a striking implement with which the batting practice device is struck.

The preferred target member will have a bore hole therethrough, and the elongate retaining rod will be received within the bore hole. To retain the target member on the elongate retaining rod, a ball stop will be disposed at the distal end of the elongate retaining rod. In such a case, the target member can have a countersunk bore hole portion surrounding the bore hole whereby the ball stop can be counter sunk within the countersunk bore hole portion and whereby damage to a striking implement by the ball stop is prevented. The ball stop can be fixed to the distal end of the elongate retaining rod or it can be removably coupled, as by a threaded fastener, so that the ball stop and the target member can be selectively removed from the elongate retaining member. With this, the target member can be removed and replaced when damaged or worn.

The means for supporting the proximal end of the rod may be in the form of a clamping structure for clamping the batting practice device to an environmental structure whereby the batting practice device can be employed in a wide variety of locations. In such a case, the clamping structure could comprise a first clamping block and a second clamping block that cooperate with a means for selectively pressing the clamping blocks together. With this, the first and second clamping blocks can be disposed to sandwich and clamp about an environmental structure.

In certain embodiments, the first and second clamping blocks may be disposed on a retaining sleeve. Also, the means for selectively pressing the first and second clamping blocks may be a clamping nut that is disposed on the retaining sleeve in cooperation with threads that are also disposed on the retaining sleeve. Preferably, a clamp stop will be fixed to the retaining sleeve so that the first and second clamping blocks can butt thereagainst when they are pressed together by the clamping nut. The preferred clamping blocks will include aligned first and second elongate clamping furrows for engaging adjacent wire strands on a chain link fence. Furthermore, pins and bore holes may be disposed in alignment of the clamping blocks to interengage with one another to prevent relative rotation of the first clamping block relative to the second clamping block.

The retaining sleeve may be tubular so that the proximal end of the elongate retaining rod can pass therethrough. In such a case, the device may include further a means for selectively fixing the elongate retaining rod relative to the retaining sleeve. Of course, this means could take a variety of forms. However, one preferred means could comprise a clamping member for selectively compressing about the elongate retaining rod. With this, the elongate retaining rod could be readily slid relative to the retaining sleeve to allow an adjustment of its effective length or to permit replacement of a damaged rod.

With a plurality of embodiments of the present invention for a batting practice device described, one will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for a batting practice device is subject to a wide variety of embodiments. However, to ensure that one skilled in the art will fully understand and, in appropriate cases, practice the present invention, certain preferred embodiments of the broader invention revealed herein are described below and shown in the accompanying drawing figures.

Figure 1:
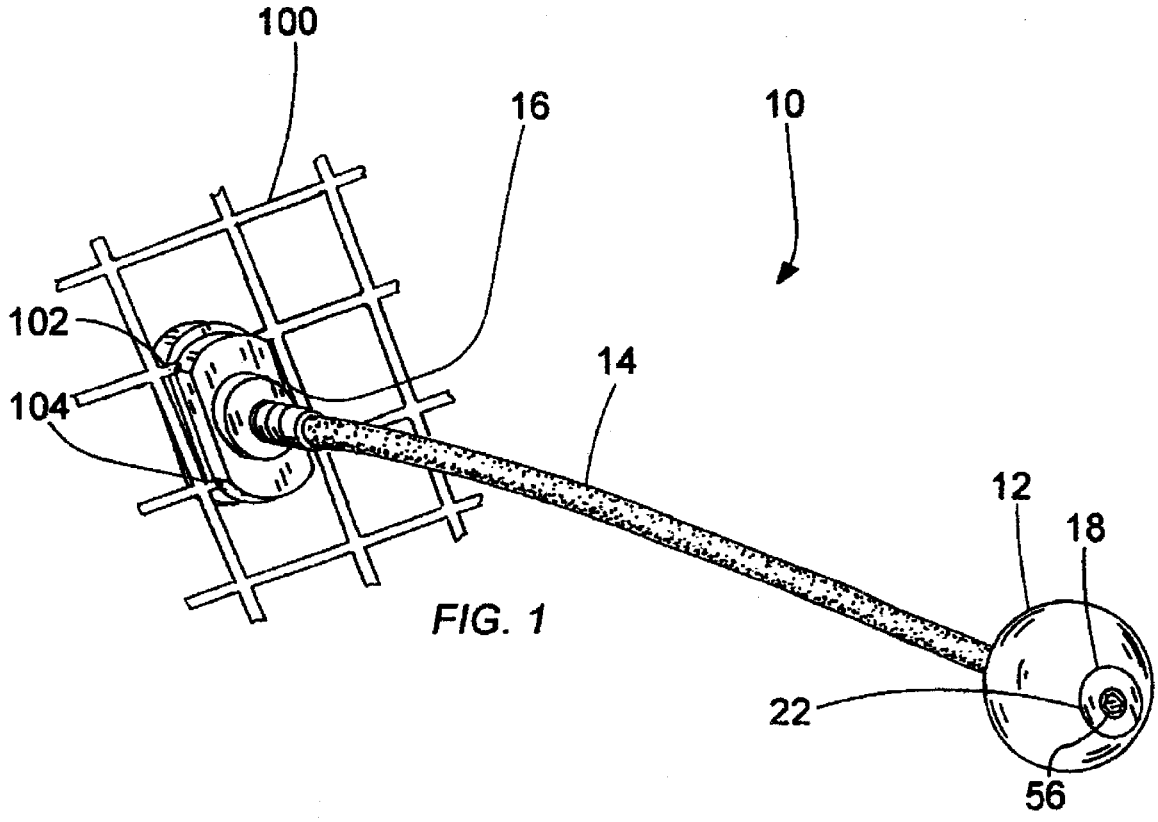
FIG. 1 is a perspective view of a batting practice device according to the present invention shown affixed to a fence.

With this in mind and looking more particularly to the accompanying figures, a preferred embodiment of the present invention for a batting practice device is depicted generally at 10 in FIG. 1. As FIG. 1 shows, the batting practice device 10 incorporates an elongate and flexible retaining rod 14 with a proximal end and a distal end. Disposed at the distal end of the flexible retaining rod 14 is a target member 12, which in this case is a standard baseball or softball. A standard baseball or softball is preferred as it most closely simulates the sensation of impact under actual playing conditions. However, the target member 12 could certainly be of a variety of types, such as a rubber ball, a plastic ball, any shape or size ball, or a member of substantially any other material. Of course, the target member 12 need not be a ball. The target member 12 could readily be employed in the shape of a puck or any other target for being struck. The only requirement is that the target member 12 be capable of withstanding an impact from a striking implement, such as a baseball or softball bat (not shown).

Similarly, the flexible retaining rod 14 certainly could be formed from a wide variety of materials. Of course, as its name would suggest, the flexible retaining rod 14 should be formed from a resiliently deformable material that will allow the batting practice device 10 to exhibit resilient deformation when the target member 12 is struck by a striking implement. For example, the flexible retaining rod 14 could be formed from a wire rope or any similarly resiliently deformable material. However, it is presently preferred to form the flexible retaining rod 14 from a strand of wire rope coated with a plastic sheath.

The target member 12 is retained at the distal end of the flexible retaining rod 14 by a ball stop 18, which in this embodiment comprises a disk that is fixed to the distal end of the flexible retaining rod 14. The ball stop 18 could be retained in place by welding or any other suitable mechanism. Alternatively, the ball stop 18 could be retained as by a threaded fastener 56 that passes through the ball stop 18 and into the distal end of the flexible retaining rod 14. With this, the ball stop 18 and the target member 12 can be readily removed so that the target member 12 can be replaced, if necessary, when worn or damaged.

Figure 2:
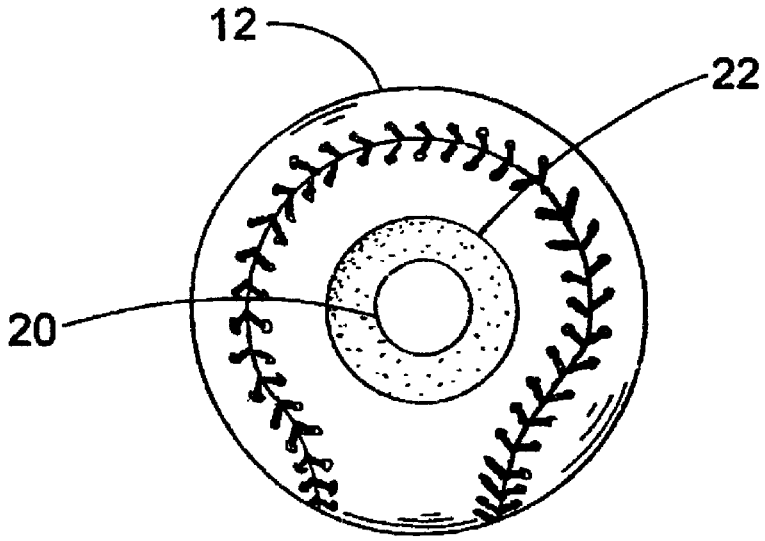
FIG. 2 is a view in front elevation of a target member according to the present invention.

As FIG. 2 shows, the target member 12 has a bore hole 20 that travels wholly through the target member 12 for receiving the flexible retaining rod 14 therethrough. The target member 12 also has a countersunk bore hole portion 22 that extends only partially through the target member 12 for receiving the ball stop 18 so that the ball stop 18 does not project therefrom. Preferably, the countersunk bore hole portion 22 will be approximately as deep as the ball stop 18 is thick. With this, the ball stop 18 will not inflict damage to a striking implement, such as a ball bat, during use of the batting practice device 10.

Figure 3:
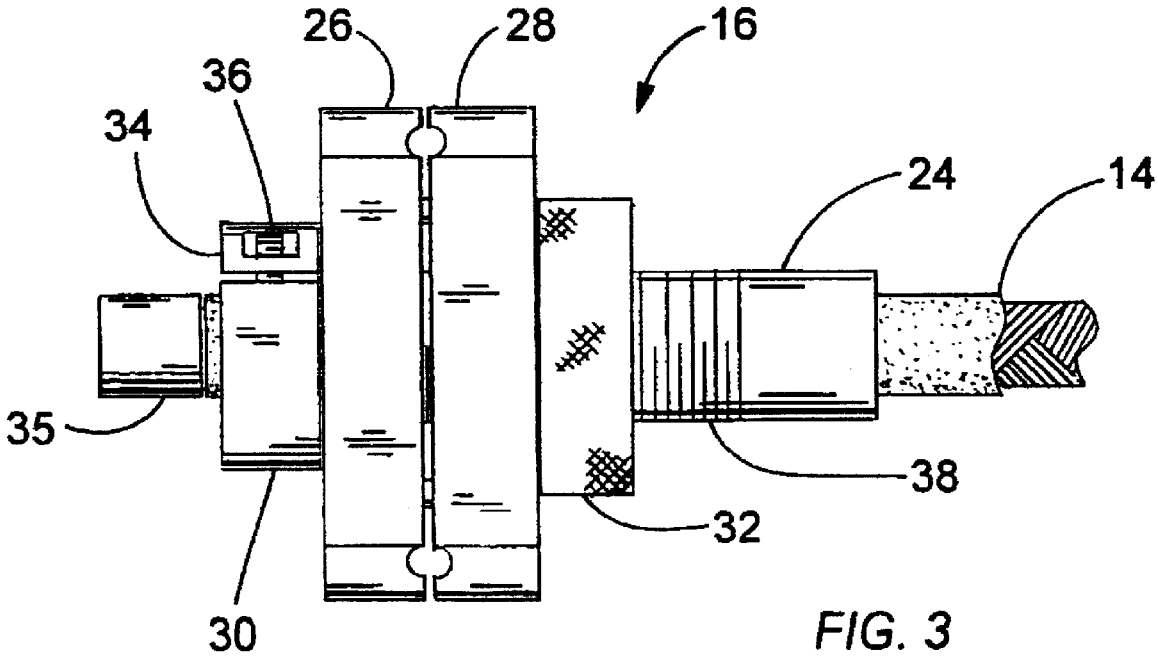
FIG. 3 is a view in side elevation of a clamping structure according to the present invention.

Disposed at the proximal end of the flexible retaining rod is a clamping structure, which is indicated generally at 16 in FIG. 1 and is shown more particularly in FIG. 3. As FIGS. 1 and 3 show, the clamping structure 16 allows the batting practice device 10 to be releasably secured to a fence, such as a chain link fence 100, by a clamping of the wire strands of the fence 100 between a first clamping block 26 and a second clamping block 28 of the clamping structure 16. With this, the batting practice device 10 can be removably and replacably coupled to a fence 100 or the like and can be readily transported to a practice field or a game field.

Figure 4:
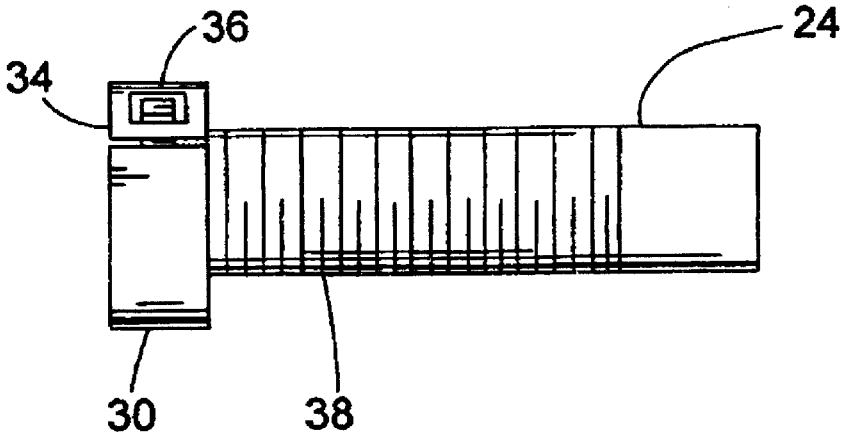
FIG. 4 is a view in side elevation of a retaining sleeve according to the present invention.
Figure 5:
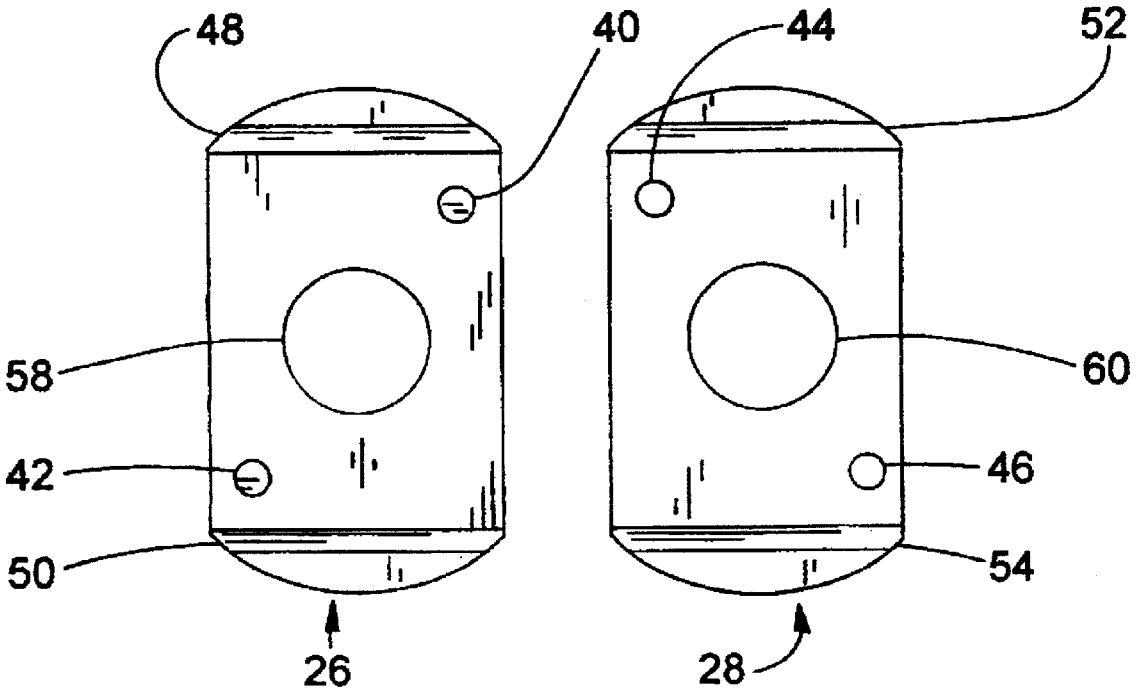
FIG. 5 is a view in front elevation of first and second clamping blocks according to the present invention.

Looking to FIG. 3, one sees that the clamping structure 16 is founded on a hollow or tubular retaining sleeve 24, which is shown more particularly in FIG. 4. The retaining sleeve 24 has a proximal end that comprises a widened disk that forms a clamp stop 30 against which the first clamping block 26 butts. Disposed in a facing relationship to the first clamping block 26 is the second clamping block 28. As FIG. 5 shows, the first and second clamping blocks 26 and 28 have apertures 58 and 60 therethrough through which the retaining sleeve 24 is received. With this, the first and second clamping blocks 26 and 28 are slidably and rotatably retained on the retaining sleeve 24.

However, the first and second clamping blocks 26 and 28 can be fixed relative to one another against relative rotation by first and second engaging pins 40 and 42 that project from the inner face of the first clamping block 26 in combination with first and second pin engaging bore holes 44 and 46 in the second clamping block 28. The first and second clamping blocks 26 and 28 certainly could be formed from a variety of materials as could the retaining sleeve 24. However, due to its relatively light weight and high strength, a properly chosen aluminum alloy appears preferable.

To the distal side of the second clamping block 28 relative to the clamp stop 30 is a clamping nut 32. The clamping nut 32 is threadedly engaged with the retaining sleeve 24 for rotation relative to threads 38 that are disposed on the retaining sleeve 24. The clamping nut 32 is knurled in this preferred embodiment for better gripping by a user without a need for tools of any kind. Although the clamping nut 32 could be crafted from many different materials, the preferred clamping nut 32 is not formed from an aluminum alloy or any other metal material because clamping nuts 32 so formed have been seen to lock relative to the second clamping block 28 thereby making relative rotation between these elements difficult. Advantageously, the present inventor has remedied this difficulty by forming the preferred clamping nut 32 from a plastic, such as an acetal resin material. For example, a preferred acetal resin is that sold under the trademark black DELRIN by the company Du Pont de Nemours, E. I. & Co. Under this arrangement, the first and second clamping blocks 26 and 28 can be pressed together or allowed to separate by relative rotation between the clamping nut 32 and the retaining sleeve 24.

As FIG. 3 shows most clearly, the flexible retaining rod 14 passes entirely through the retaining sleeve 24 such that a most distal end of the flexible retaining rod 14 projects through and beyond the clamp stop 30 with which the rod clamping member 34 is engaged. A threaded fastener 36 passes through the rod clamping member 34 and into the clamp stop 30 for selectively drawing the rod clamping member 34 toward the clamp stop 30 thereby to compress about the flexible retaining rod 14. With this, when the rod clamping member 34 so compresses about the flexible retaining rod 14, the flexible retaining rod 14 will be fixed in place relative to the clamping member 34 and the retaining sleeve 24 in general. With this, a user can selectively fix the flexible retaining rod 14 in place during use of the batting practice device 10, and a user can loosen the rod clamping member 34 to allow the flexible retaining rod 14 to be slid relative to the retaining sleeve 24.

However, the invention provides a further means for preventing the flexible retaining rod 14 from inadvertently being pulled from within the retaining sleeve 24 in the form of a stop sleeve 35, which is disposed surrounding the most proximal end of the flexible retaining rod 14. As FIG. 3 shows, the stop sleeve 35 comprises a cylindrical sleeve, preferably formed from metal, that is fixed to the flexible retaining rod 14 as by welding or similar methods. For completeness, one will note that the plastic sheathing ceases over the length of the flexible retaining rod 14 in the area of the stop sleeve 35, and the stop sleeve 35 has a diameter approximately equal to the diameter of the flexible retaining rod 14 over the portion where the flexible retaining rod 14 is coated with plastic sheathing.

As a result, the effective length of the flexible retaining rod 14 as it extends beyond the distal end of the retaining sleeve 24 can be readily adjusted if necessary. Furthermore, the flexible retaining rod 14 can be entirely removed from the retaining sleeve 24. This would be useful, of course, if replacement of the flexible retaining rod 14 is required due to damage or the like.

Looking again to FIG. 5, one sees that the first clamping block 26 has a first clamping furrow 48 and a second clamping furrow 50 communicating across its inside face. The first and second clamping furrows 48 and 50 are disposed in a generally parallel relationship. In this exemplary embodiment, each of the first and second clamping furrows 48 and 50 has a centerline that is disposed approximately 1 and ⅛ inches from the center of the aperture 58 whereby the centerlines of the first and second furrows 48 and 50 are separated by a distance of approximately 2 and ¼ inches. Advantageously, this distance matches the distance between adjacent wire strands on a typical chain link fence, such as that indicated at 100 in FIG. 1. Matching first and second clamping furrows 52 and 54 are disposed on the second clamping block 28.

Under this arrangement, installation and use of the batting practice device 10 is extraordinarily simple. For example, a typical practice session with the batting practice device 10 might begin with a user's rotating the clamping nut 32 counter-clockwise so that it travels along the retaining sleeve 24 toward the distal end thereof. With this, the first and second clamping blocks 26 and 28 can be separated, and the blocks 26 and 28 can be disposed to sandwich adjacent strands 102 and 104 of a fence 100 as is shown in FIG. 1 with the first clamping furrows 48 and 52 aligned with the first strand 102 and the second clamping furrows 50 and 54 aligned with the second strand 104. The clamping nut 32 could then be rotated in a clockwise direction thereby causing it to travel along the retaining sleeve 24 toward the proximal end thereof. With this, the first and second clamping blocks 26 and 28 will be compressed together to fix the first and second strands 102 and 104 in place within the respective channels defined by the first clamping furrows 48 and 52 and the second clamping furrows 50 and 54. If necessary, the effective length of the flexible retaining rod 14 could be adjusted by loosening the rod clamping member 34 and sliding the flexible retaining rod 14 any desired amount.

With the batting practice device 10 so affixed to a fence 100, a batter can immediately employ the batting practice device 10 to practice his or her batting technique or to warm up prior to the start of a game or a given at bat. For example, a batter could strike the target member 12 repeatedly during practice, possibly under the instruction of a coach or the like, to improve his or her batting ability. Furthermore, a batter could take a number of swings at the target member 12 immediately prior to stepping to home plate to refresh his or her muscle memory and, possibly, to quell his or her nerves. With each strike of the target member 12 by a striking implement, the flexible retaining rod 14 and thus the target member 12 will deflect a given amount only to return to its approximate starting position due to the resiliency of the flexible retaining rod 14. As a side note, the astute observer may realize that attaching the batting practice device 10 to the links of a chain link fence 100 has the further advantage of having the fence 100 itself contribute to the resiliency of the batting practice device 10 in general as the links of the fence 100 will tend to give resiliently along with the flexible retaining rod 14.

Advantageously, as one might infer from the foregoing, the batting practice device 10 can be installed in an exceedingly rapid manner without a need for any tools whatsoever. With this, installation of the device 10 will not be likely to interfere with the play of a given game, to discourage its own use, or to detract from the time available for using the device 10. Furthermore, the device 10 is exceedingly simple in construction, much simpler than prior art practice devices, and has no moving parts during use. As a result, it can be manufactured in an efficient manner and demonstrates little susceptibility to breakage or malfunction. Most importantly, of course, the device 10 provides an effective means for a player to practice batting and to warm up prior to a game or a given at bat.

From the foregoing, it will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments. With the foregoing in mind, the following claims are intended to define the scope of protection to be afforded to the present inventor, and the claims shall be deemed to include equivalent constructions insofar as they do not depart from the spirit and scope of the present invention.

One should further note that a plurality of the following claims express certain elements as a means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. A batting practice device for enabling a user to practice batting and to warm up prior to a game or a given at bat, the batting practice device comprising:

an elongate retaining rod with a proximal end and a distal end;

a target member affixed directly to the distal end of the elongate retaining rod;

wherein the elongate retaining rod is resiliently flexible wherein the target member and the elongate retaining rod will tend to deflect in response to an impact by a striking implement and wherein target member and the elongate retaining rod will tend to return approximately to an initial position after an impact and wherein the elongate retaining rod comprises a strand of wire rope whereby the elongate retaining rod will demonstrate exemplary durability;

a means for supporting the proximal end of the elongate retaining rod comprising a clamping structure for clamping the batting practice device to an environmental structure wherein the clamping structure comprises a first clamping block and a second clamping block in cooperation with a means for selectively pressing the clamping blocks together whereby the first and second clamping blocks can be disposed to sandwich and clamp about the environmental structure; and a retaining sleeve wherein the first and second clamping blocks are disposed on the retaining sleeve;

whereby a ball player can practice and can warm up prior to a game or a given at bat by striking the target member with the striking implement.

2. The batting practice device of claim 1 further comprising a protective coating disposed over the elongate retaining rod whereby the batting practice device will not tend to damage a striking implement with which the batting practice device is struck.

3. The batting practice device of claim 1 wherein the target member has a bore hole therethrough and wherein the elongate retaining rod is received with the bore hole.

4. The batting practice device of claim 3 further comprising a ball stop disposed at the distal end of the elongate retaining rod wherein the target member is disposed proximally to the ball stop whereby the ball stop retains the target member on the elongate retaining rod.

5. The batting practice device of claim 4 further comprising a countersunk bore hole portion surrounding the bore hole in the target member whereby the ball stop can be counter sunk within the countersunk bore hole portion whereby damage to a striking implement by the ball stop is prevented.

6. The batting practice device of claim 4 wherein the ball stop is fixed to the distal end of the elongate retaining rod.

7. The batting practice device of claim 4 wherein the ball stop is removably coupled to the distal end of the elongate retaining rod whereby the ball stop and, thus, the target member can be removed from the elongate retaining rod.

8. A batting practice device for enabling a user to practice batting and to warm up prior to a game or a given at bat, the batting practice device comprising:

an elongate retaining rod with a proximal end and a distal end;

a target member coupled to the distal end of the elongate retaining rod;

a retaining sleeve coupled to the proximal end of the elongate retaining rod;

a first clamping block disposed on the retaining sleeve;

a second clamping block slidably disposed on the retaining sleeve; and a means for selectively pressing the clamping blocks together whereby the first and second clamping blocks can be disposed to sandwich and clamp about an environmental structure thereby to clamp the batting practice device to the environmental structure to support the proximal end of the elongate retaining rod wherein the means for selectively pressing the first and second clamping blocks together comprises a clamping nut disposed on the retaining sleeve in cooperation with threads disposed on the retaining sleeve;

whereby a ball player can practice batting and can warm up prior to a game or a given at bat by striking the target member with a striking implement.

9. The batting practice device of claim 8 further comprising a clamp stop fixed to the retaining sleeve on a first side of the first and second clamping blocks and wherein the clamping nut is disposed on a second side of the first and second clamping blocks.

10. The batting practice device of claim 8 further comprising first and second elongate clamping furrows disposed on the first clamping block for engaging elements of an environmental structure.

11. The batting practice device of claim 10 further comprising first and second elongate clamping furrows disposed on the second clamping block in alignment with the first and second clamping furrows on the first clamping block.

12. The batting practice device of claim 8 further comprising at least one pin that projects from the first clamping block and at least one bore hole disposed within the second clamping block in alignment with the at least one pin whereby the at least one pin and the at least one aperture can engage in a mating relationship to prevent relative rotation of the first clamping block relative to the second clamping block.

13. The batting practice device of claim 8 wherein the retaining sleeve is tubular and wherein the proximal end of the elongate retaining rod passes through the retaining sleeve and further comprising a means for selectively fixing the elongate retaining rod relative to the retaining sleeve.

14. The batting practice device of claim 13 wherein the means for selectively fixing the elongate retaining rod relative to the retaining sleeve comprises a clamping member for compressing about the elongate retaining rod.

15. The batting practice device of claim 8 further comprising a stop sleeve fixed to the proximal end of the elongated retaining rod for preventing the proximal end of the retaining rod from passing through the retaining sleeve inadvertently.

16. The batting practice device of claim 8 wherein the elongate retaining rod is resiliently flexible whereby the target member and the elongate retaining rod will tend to deflect in response to an impact by a striking implement and whereby the target member and the elongate retaining rod will tend to return approximately to an initial position after an impact by a striking implement, wherein the elongate retaining rod comprises a strand of wire rope whereby the enlongate rod will demonstrate exemplary durability, and wherein the target member is affixed directly to the distal end of the elongate retaining rod.

* * * * *